United States Patent [19]

Davenport et al.

[11] 4,201,017

[45] May 6, 1980

[54] METHODS AND APPARATUS FOR THE TREATMENT OF PRODUCTS

[75] Inventors: Anthony F. Davenport; Harry B. Brailsford, both of Stoke-on-Trent, England

[73] Assignee: William Boulton Limited, Stoke-on-Treat, England

[21] Appl. No.: 907,731

[22] Filed: May 19, 1978

Related U.S. Application Data

[63] Continuation-in-part of Ser. No. 723,844, Sep. 16, 1976, abandoned.

[51] Int. Cl.[2] ..... B24B 31/00

[52] U.S. Cl. ..... 51/163.2; 51/313; 366/219

[58] Field of Search ..... 366/219; 51/163.1, 163.2, 51/313–316, 7

[56] References Cited

U.S. PATENT DOCUMENTS

| | | | |
|---|---|---|---|
| 3,100,088 | 8/1963 | Podmore | 51/163.2 X |
| 3,217,561 | 11/1965 | Allgaier | 259/72 X |
| 3,400,495 | 9/1968 | Balz | 51/163.2 |
| 3,435,564 | 4/1969 | Balz | 51/163.2 |
| 3,553,900 | 1/1971 | McKibben | 51/163.2 |
| 3,676,958 | 7/1972 | Garland | 51/163.2 |
| 3,771,266 | 11/1973 | Kobayashi | 51/163.2 |
| 3,924,357 | 12/1975 | Schmidt | 51/314 X |
| 3,943,668 | 3/1976 | McKibben | 51/163.2 |

FOREIGN PATENT DOCUMENTS

| | | | |
|---|---|---|---|
| 271328 | 9/1970 | U.S.S.R. | 51/163.2 |
| 294715 | 3/1971 | U.S.S.R. | 51/163.2 |

*Primary Examiner*—Harold D. Whitehead
*Attorney, Agent, or Firm*—Alan H. Levine

[57] ABSTRACT

A method and apparatus for the treatment of products, such as for mixing materials, in which the products are introduced into a chamber having a spiral treatment path, a central inlet and a peripheral outlet and disposed in a horizontal plane, the products being subjected to vibratory movement to constrain them to travel along and around the spiral path from the inlet to the outlet.

12 Claims, 2 Drawing Figures

METHODS AND APPARATUS FOR THE TREATMENT OF PRODUCTS

Figure 1:
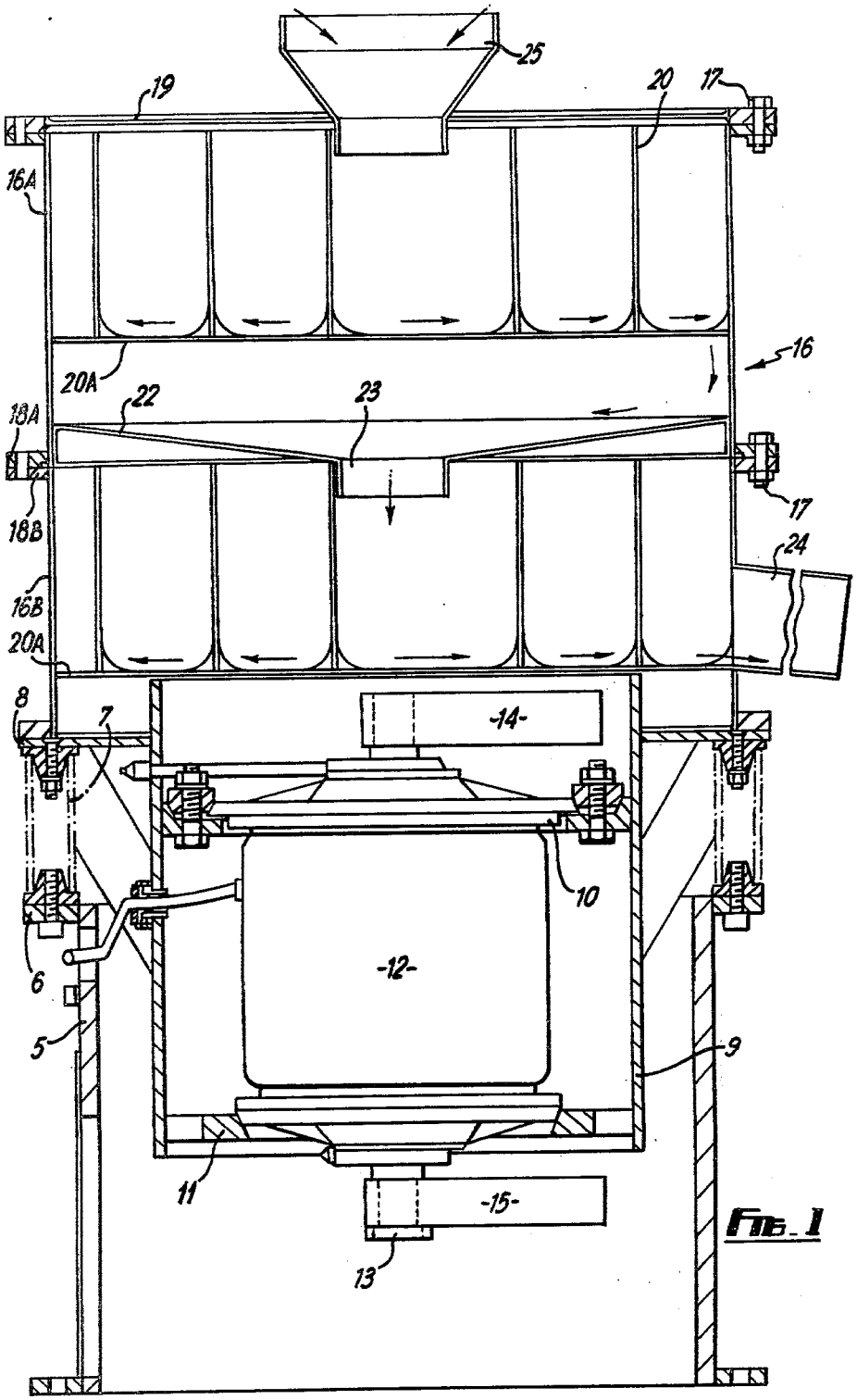

This application is a continuation-in-part of copending application Ser. No. 723,844, filed Sept. 16, 1976, and now abandoned.

The invention relates to methods and apparatus for the treatment of products. The invention is primarily applicable to the mixing of materials but may also be used for drying or for effecting finishing operations such as grinding, de-burring, polishing and the like.

According to the invention there is provided a method of treating products comprising introducing at least two products into a treatment vessel, subjecting the vessel to a vibratory movement in the form of a rotary oscillation about a vertical axis with an up and down component superimposed thereon, constraining the charge to travel along and around a spiral path of gradually increasing radius in a horizontal plane from a central receiving zone to a peripheral discharge zone, and discharging the products at said discharge zone.

The invention also provides apparatus for use in the treatment of products comprising a chamber defining a spiral treatment path of gradually increasing radius and disposed in a horizontal plane, an inlet opening disposed centrally of the spiral path, a peripheral discharge opening and means for subjecting the chamber to a vibratory movement in the form of a rotary oscillation about a generally vertical axis with an up and down component superimposed thereon whereby to constrain a mixture of at least two products to travel along and around the spiral path from the central inlet opening to the discharge opening.

When used for mixing, the products will consist of at least two materials to be mixed together. When used for grinding or finishing operations the products will consist of parts or components to be treated together with grinding or finishing media which, during movement of the charge around the spiral path are brought into rubbing contact with the parts or components to effect the desired finishing operation thereon.

Preferably the treatment chamber is resiliently mounted on a fixed base and subjected to vibratory movement transmitted thereto from a drive motor having a vertical shaft fitted with at least one eccentric weight. In a preferred arrangement the treatment chamber is supported on an annular series of coil springs and the drive motor is carried by the treatment chamber and fitted with upper and lower eccentric weights at least one of which is angularly adjustable about the motor shaft.

The treatment chamber may comprise two or more sections disposed one above the other and arranged such that products discharged from the discharge outlet of the or each upper section are delivered to the inlet opening of the section below. In this way continuous mixing or other treatment may be carried out by continuously supplying products to the inlet opening of the uppermost treatment chamber and continuously removing the mixed or otherwise treated products from the discharge outlet of the lowermost chamber.

Figure 2:
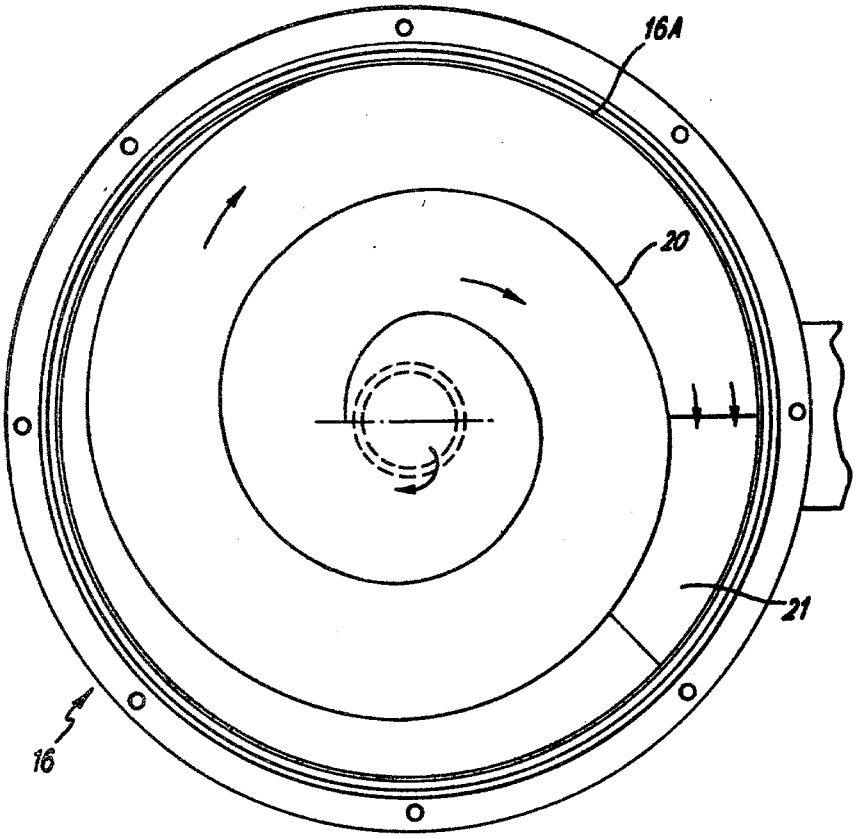

One embodiment of the invention will now be described, by way of example only, with reference to the accommpanying drawings, in which:

FIG. 1 is a vertical cross-section through a vibratory mixing machine according to the invention; and FIG. 2 is a plan view of the machine shown in FIG. 1 with the top cover removed.

Referring to the drawings, the apparatus comprises a base 5 of generally cylindrical shape having an outwardly directed horizontal flange 6 at its upper end on which are located a number of vertical coil springs 7 forming an annular series. The upper ends of the springs 7 are connected to an annular horizontal plate 8 having attached to it a central cylindrical sleeve 9. Upper and lower mounting brackets or collars 10, 11 are mounted within the sleeve 9 and carry an electric motor 12 having a shaft 13 which is vertically disposed on the central axis of the machine. The shaft 13 carries upper and lower eccentric weights 14 and 15 which are independently adjustable angularly so that they can be set out of balance to create or vary the vibratory motion applied to the plate 8 and the superstructure mounted on it. The rotating out of balance masses represented by the weights set up a vibratory motion of a rotational character with upward and downward components in the movement which is of high frequency and low amplitude.

A treatment chamber 16 is mounted on the plate 8 and comprises an upper section 16A and a lower section 16B. These sections are detachably connected to one another by bolts 17 passing through flanges 18A, 18B on the respective parts of the treatment chamber. A cover plate 19 is bolted to the upper section 16A in a similar manner and the lower section 16B is bolted to the flange 8.

Each section of the treatment chamber comprises a spiral treatment path defined by a baffle plate 20 as best seen in FIG. 2 of the drawings. The floor 20A of the treatment path is horizontal so that the path gradually increases in radius in the same horizontal plane. By virtue of this construction a charge of materials to be mixed introduced at the centre of either section of the treatment chamber is constrained to travel around and along the spiral treatment path while being subjected to movement resulting from the vibration of the machine. Each section of the treatment chamber is provided with a peripheral discharge outlet, the outlet in the upper section 16A comprising an opening 21 (FIG. 2) in the floor thereof from which material is discharged into a conical collecting tray 22 having a central opening 23 serving to deliver material to the centre of the lower section of the treatment chamber. The peripheral outlet in the lower section of the chamber comprises a discharge chute 24 by means of which mixed material is discharged from the machine.

Materials to be mixed are introduced into the central region of the upper section of the treatment chamber by means of a feed inlet 25 supported on the top cover 19.

By virtue of the spiral construction of the upper and lower sections of the treatment chamber together with the vibratory movement provided by the motor and weights and the resilient mounting of the treatment chamber on the fixed base of the machine, the charge of materials to be mixed moves along and around each of the spiral sections of the chamber in turn and also undergoes orbital or circular movement in generally vertical planes substantially at right angles to the direction of movement round the chamber. This produces particularly effective mixing of the materials and, due to the relatively long treatment path provided, continuous mixing can be effected by introducing materials to be mixed continuously at the feed inlet 25 in the upper section of the treatment chamber and removing mixed material continuously from the discharge outlet 24 of the lower section.

Since each section of the treatment chamber comprises a spiral path disposed in a horizontal plane, the charge of materials to be mixed moves horizontally outwards from the inlet to the outlet and does not require to rise at any point from a lower to a higher level. The charge does not therefore need to be lifted against the force of gravity and indeed the outward horizontal movement is assisted by centrifugal force.

The frequency and amplitude of the vibratory movement may be varied to meet different requirements but frequencies of the order of 900 to 3,000 r.p.m. and amplitudes of about 1/64 to ⅜ inch would be appropriate for most mixing operations. Different frequencies and/or amplitudes may be required in using machines of the kind described for grinding, polishing, de-burring or other surface finishing operations.

The nature of the vibratory movement may be varied to suit different materials by adjusting the relative angular positions of the upper and lower eccentric weights, by varying the speed of rotation of the motor or by altering the vertical position of the motor relative to the treatment chamber. While in the embodiment described the motor is mounted in a fixed position, provision may be included to allow for vertical adjustment of the motor within the sleeve 9 if required.

Various other modifications may be made without departing from the invention. For example only one spiral treatment chamber or more than two such chambers may be provided if required and the base of the spiral treatment path may be of flat rather than arcuate form. Since the treatment chamber is closed by means of the top cover, the temperature, pressure or moisture content of the air in the chamber may be controlled to suit different requirements. Moreover though reference has been made to vibration by use of an electric motor fitted with eccentric weights, the necessary movement may be induced in other ways, for example by use of electro-magnetic or piezo-electric vibrators or by the use of air or hydraulic motors fitted with weights. The angular positions of the weights could be arranged to be adjustable by remote control during operation to alter the nature of the vibration at different stages in the process. The treatment chamber could also be mounted on air springs instead of coil springs or could be otherwise resiliently supported.

We claim:

1. A method of treating products comprising introducing a charge of at least two products into a treatment vessel, subjecting the vessel to a vibratory movement in the form of a rotary oscillation about a generally vertical axis with an up and down component superimposed thereon, constraining the charge to travel along and around a spiral path of gradually increasing radius in a horizontal plane from a central receiving zone to a peripheral discharge zone, and discharging the products at said discharge zone.

2. A method according to claim 1 wherein the frequency of said movement is between 900 and 3,000 revs/min. and the amplitude between 1/64 and ⅜ inch.

3. A method according to claim 1 or 2 wherein said products comprise materials to be mixed together.

4. A method according to claim 1 or 2 wherein said products comprise materials to be ground and grinding media.

5. A method according to claim 1 or 2 wherein said products comprise components to be finished and finishing media.

6. Apparatus for use in the treatment of products comprising a chamber defining a spiral treatment path of gradually increasing radius and disposed in a horizontal plane, an inlet opening disposed centrally of the spiral path, a peripheral discharge opening and means for subjecting the chamber to a vibratory movement in the form of a rotary oscillation about a generally vertical axis with an up and down component superimposed thereon whereby to constrain a mixture of at least two products to travel along and around the spiral path from the central inlet opening to the discharge opening.

7. Apparatus according to claim 6 wherein the treatment chamber is resiliently mounted on a fixed base and subjected to vibratory movement transmitted thereto from a drive motor having a vertical shaft fitted with at least one eccentric weight.

8. Apparatus according to claim 7 wherein the treatment chamber is supported on an annular series of coil springs and the drive motor is carried by the treatment chamber and fitted with upper and lower eccentric weights.

9. Apparatus according to claim 8 wherein at least one of said weights is angularly adjustable about the motor shaft.

10. Apparatus according to claim 7, 8 or 9 wherein the motor is vertically moveable relative to the treatment chamber.

11. Apparatus according to claim 6 wherein said treatment chamber comprises two or more sections disposed one above the other and arranged such that products discharged from the discharge outlet of the or each upper section are delivered to the inlet opening of the section below.

12. Apparatus according to claim 6 wherein said treatment chamber is closed by means of a top cover, means being provided for controlling the temperature, pressure and/or moisture content of the air in the chamber.

* * * * *